US006581290B1

(12) United States Patent
Fishel

(10) Patent No.: US 6,581,290 B1
(45) **Date of Patent: *Jun. 24, 2003**

(54) SHAVING SYSTEM WITH VARIABLE SIZED RAZOR CARTRIDGES

(76) Inventor: Rhonda Fishel, 5505 Yates Rd., Lakeland, FL (US) 33811

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/149,753

(22) Filed: Sep. 8, 1998

(51) Int. Cl.[7] ..... B26B 21/08

(52) U.S. Cl. ..... 30/50; 30/51; 30/526; 132/289

(58) Field of Search ..... 30/40, 40.2, 50, 30/51, 32, 526, 527, 532, 533, 34.1; 132/289–292, 215; 206/228, 354, 356; D28/46, 47

(56) References Cited

U.S. PATENT DOCUMENTS

| | | | | | |
|---|---|---|---|---|---|
| 1,135,611 | A | * | 4/1915 | Petosky | 30/50 |
| 2,121,000 | A | * | 6/1938 | Anderson | 30/47 |
| 2,505,493 | A | * | 4/1950 | Herrmann | 30/50 |
| 2,587,964 | A | * | 3/1952 | Burns | 30/50 X |
| 4,128,172 | A | | 12/1978 | Joyce | 206/352 |
| 4,285,124 | A | * | 8/1981 | Diakonov | 30/34.1 |
| 4,339,876 | A | | 7/1982 | Davis | 132/289 |
| 4,461,078 | A | * | 7/1984 | Carreker | 30/50 X |
| 4,501,066 | A | * | 2/1985 | Sceberras | 30/50 |
| 4,663,843 | A | * | 5/1987 | Savage | 30/50 X |
| 4,939,840 | A | | 7/1990 | Butka | 30/37 |
| 4,980,974 | A | * | 1/1991 | Radcliffe | 30/50 |
| 4,989,328 | A | * | 2/1991 | Sokoloff | 30/34.1 |
| 5,347,717 | A | * | 9/1994 | Ts'ai | 30/50 X |
| 5,469,621 | A | | 11/1995 | Alsept et al. | 30/50 |
| 5,479,950 | A | | 1/1996 | Andrews | 132/215 |
| 5,778,535 | A | * | 7/1998 | Ledesma | 30/50 |
| 6,125,857 | A | * | 10/2000 | Silber | 30/50 X |

OTHER PUBLICATIONS

XACTO Precision Razor Saw Set, Electronix Express, www.elexp.com, copyright 1996–2002.*

* cited by examiner

*Primary Examiner*—Clark F. Dexter

(57) ABSTRACT

A shaving unit having a handle which accepts razor cartridges of various lengths is provided. The handle of the unit includes a head with a razor cartridge receptacle. A cartridge kit is provided containing razor cartridges with blades of two or more different lengths. The razor cartridge receptacle of the shaving unit is designed to detachably retain any one of the cartridges selected, regardless of blade size.

15 Claims, 2 Drawing Sheets

SHAVING SYSTEM WITH VARIABLE SIZED RAZOR CARTRIDGES

BACKGROUND OF THE INVENTION

This invention relates to a unique shaving system, and more particularly, to a shaving kit with multiple razor cartridges of various sizes.

Most manufactured razors have a blade length of approximately 35 mm. Even though there are various types of blades (i.e., double), as well as various types of handles, that are made and are otherwise being used, the blade cartridge itself is always the same length (35 mm). The reason for this is unclear, but may have been to satisfy industry needs regarding shaving a man's face.

For women, a 35 mm blade or cartridge is less than desirable. In general, women shave two bodily areas, the underarm and the leg. These bodily areas have very different contours and surface areas. Accordingly, shaving these areas may be facilitated by using blades of different lengths or size. For example, the underarm is quite narrow, and a conventional 35 mm blade often nicks the user's skin during shaving. The underarm would obviously be better served by using a shorter sized razor blade. On the other hand, the leg of a women, particularly the area near the knee, has a wide, rather flat surface contour that could be shaved more efficiently by using a longer length blade.

One possible solution in shaving the body areas of a woman is to design a blade unit which could expand or contract in length as needed. However, such a design would be less than desirable, since it would most likely require placing a pair of blade elements next to each other, possibly causing skin injury when used during shaving. Another possible solution would be to have blades with different lengths on each end of the handle. The obvious problem is that such a design would be very dangerous to use.

Accordingly, it is desirable to provide a shaving system which overcomes the above-mentioned disadvantages.

SUMMARY OF THE INVENTION

Generally speaking, in accordance with the invention, a shaving unit having a handle which accepts razor cartridges of various lengths is provided. The handle of the unit includes a head with a razor cartridge receptacle. A cartridge kit is provided containing razor cartridges with blades of two or more different lengths. The razor cartridge receptacle of the shaving unit is designed to detachably retain any one of the cartridges selected, regardless of blade size.

Accordingly it is an object of the invention to provide an improved shaving unit.

Another object of the invention is to provide a shaving unit with a plurality of interchangeable removable cartridges of various lengths.

A further object of the invention is to provide a shaving unit especially designed for shaving the bodily areas of a woman.

Still other objects and advantages of the invention will in part be obvious and will in part be apparent from the following description.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
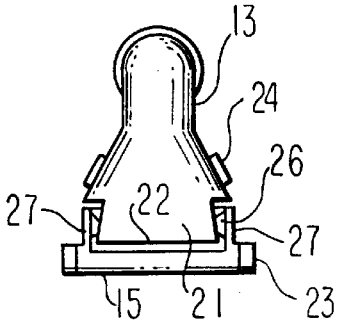
FIG. 1 is a top plan view of the inventive shaving unit with a 27 mm razor cartridge.
Figure 2:
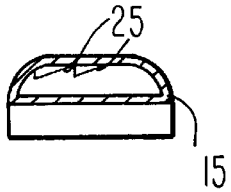
FIG. 2 is a cross-sectional view of the unit depicted in FIG. 1.
Figure 3:
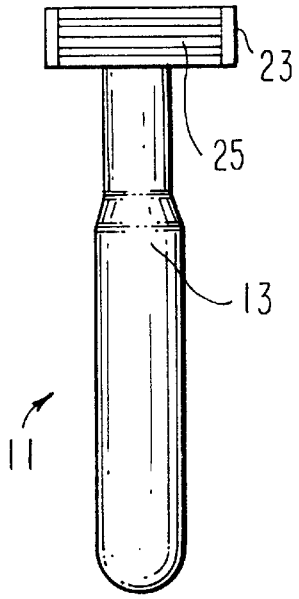
FIG. 3 is a front elevational view of the unit depicted in FIG. 1.
Figure 4:
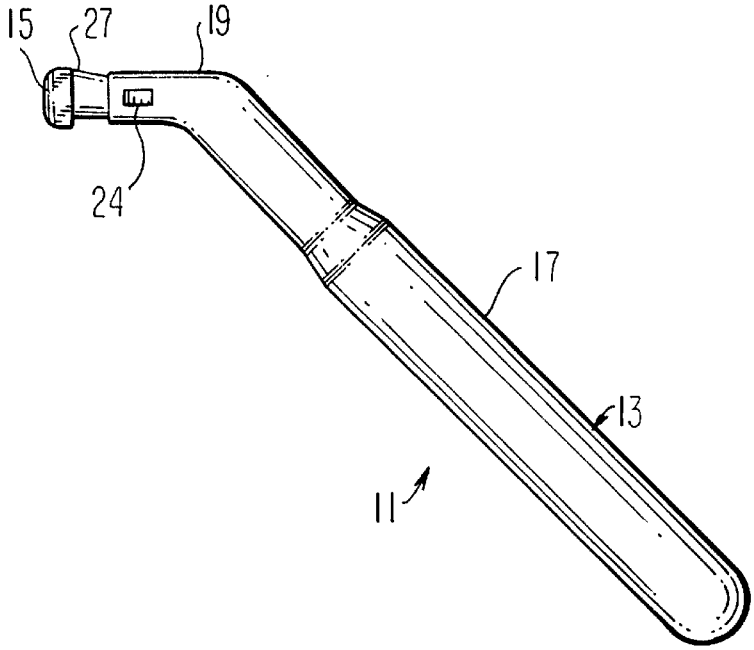
FIG. 4 is a side elevational view of the unit depicted in FIG. 1.

Referring first to FIGS. 1–4, a shaving system generally indicated at 11 and made in accordance with the invention is shown. Unit 11 comprises a razor handle 13 and a first detachable razor cartridge 15.

Handle 13 has a grip portion 17, a neck 19 and a head 21. Head 21 is formed with a receptacle 22 to which razor cartridge 15 is detachably coupled. Cartridge 15 has sides 23 between which a flexible razor blade 25 is retained. Cartridge 15 includes a pair of lugs 27 for detachable coupling to receptacle 22. This is achieved by operating release buttons 24 disposed along neck 19 of handle 13, which activates spring-loaded cartridge lock 26. When the cartridge lock is not activated, its ends extend past the sides of head 21, grabbing lugs 27 of cartridge 15. When activated, the ends of lock 26 are urged inwardly, releasing cartridge 15 from coupled engagement with receptacle 22. This enables replacement of unit 11 with a different sized cartridge.

In FIGS. 1–4, cartridge 15 has a length of about 27 mm. The length of blade 25 is sized for use in shaving the underarm of a woman.

Figure 5:
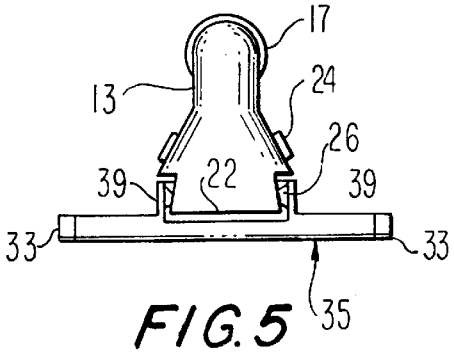
FIG. 5 is a top plan view of the inventive shaving unit with a 50 mm razor cartridge.
Figure 6:
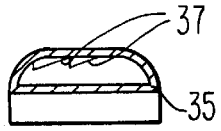
FIG. 6 is a cross-sectional view of the shaving unit depicted in FIG. 5.
Figure 7:
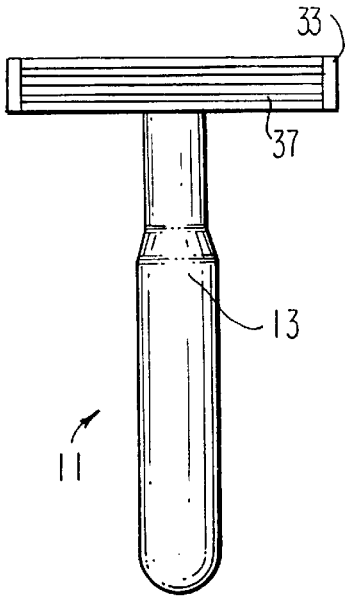
FIG. 7 is a front elevational view of the shaving unit depicted in FIG. 5.
Figure 8:
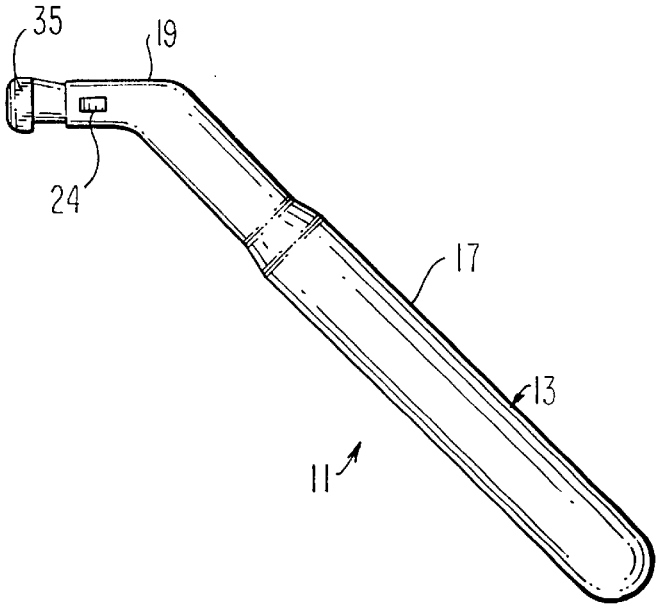
FIG. 8 is a side elevational view of the shaving unit depicted in FIG. 5.

Referring to FIGS. 5–8, a razor cartridge 35 is shown detachably coupled to receptacle 22 of razor handle 13. Cartridge 35 has sides 33 between which a second flexible razor blade 37 is retained. Cartridge 35 includes a pair of lugs 39 for detachable coupling to receptacle 22, as described above. Cartridge 35 has a length of about 50 mm. Blade 37, as can be appreciated, is of a different length (longer) than blade 25 depicted in FIGS. 1–4 and is sized for use in shaving the leg of a woman.

It will thus be seen that the objects set forth above, among those made apparent from the preceding description, are efficiently attained. Certain changes may be made in the design of the invention without a departing from the spirit and scope thereof. It is also understood that the inventive scope is defined by the claims.

What is claimed is:

1. A shaving kit comprising:

a shaver comprising a single elongated handle having a single head with a single razor cartridge receptacle; and a plurality of different sized detachable razor cartridges each with an attachment mechanism for selective engagement with said single razor cartridge receptacle such that said cartridge receptacle can selectively retain any one of said different sized cartridges, each said razor cartridge having a razor blade mounted therein;

wherein said attachment mechanism engages said razor cartridge receptacle such that a cutting edge of said razor blade extends substantially orthogonally to said elongated handle; and wherein said plurality of different sized razor cartridges includes a first razor cartridge having a length different than the length of a second razor cartridge.

2. The shaving kit of claim 1, wherein the razor bade of each said plurality of cartridges has a length substantially corresponding to the length of its respective cartridge.

3. The shaving kit of claim 1, wherein said handle has a grip portion and a neck leading to said head.

4. The shaving kit of claim 1, wherein said attachment mechanism of each of said razor cartridges includes at least one lug for selective coupling with said single cartridge receptacle of said single handle.

5. The shaving kit of claim 4, wherein said single razor cartridges receptacle includes at least one displaceable lock member for selectively engaging said at least one lug.

6. The shaving kit of claim 5, wherein said lock member is spring-loaded.

7. The shaving kit of claim 5, wherein said at least one lock member is selectively displaceable by operating a button, wherein said button is operably connected to said at least one lock member and located along said single handle.

8. The shaving kit of claim 1, wherein the length of the blade of at least one of said plurality of razor cartridges is designed for shaving the underarm of a woman.

9. The shaving kit of claim 1, wherein the length of the blade of at least one of said plurality of razor cartridges is designed for shaving the leg of a woman.

10. A shaver kit comprising a plurality of different sized razor cartridges, each having a razor blade mounted therein, one of said razor cartridges having a first length and another of said razor cartridges having a second length, and a single elongated handle having a single head with a single razor cartridge receptacle, each of said razor cartridges having an attachment mechanism for selective engagement with said single razor cartridge receptacle such that said single razor cartridge receptacle is capable of detachably retaining any one of said plurality of different sized razor cartridges;

wherein said attachment mechanism engages said razor cartridge receptacle such that a cutting edge of said razor blade extends substantially orthogonally to said elongated handle.

11. The shaver kit of claim 10, wherein said attachment mechanism comprises at least one lug, and wherein said razor cartridge receptacle includes a coupling member for selective coupling with each said lug of any of said plurality of razor cartridges.

12. The shaver kit of claim 11, wherein said coupling member includes at least one displaceable lock member for selectively engaging said lug.

13. The shaver kit of claim 12, wherein said lock member is spring-loaded.

14. The shaver kit of claim 12, wherein said lock member is selectively displaceable by operating a button, wherein said button is operably connected to said at least one lock member and located along said single handle.

15. The shaver kit of claim 10, wherein said razor cartridge having said first length is for shaving one body part and said razor cartridge having said second length is for shaving another body part.

* * * * *